US006250467B1

(12) United States Patent
Weder

(10) Patent No.: US 6,250,467 B1
(45) Date of Patent: Jun. 26, 2001

(54) INFLATABLE SHIPPING DEVICE

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

(21) Appl. No.: 09/422,536

(22) Filed: Oct. 21, 1999

(51) Int. Cl.[7] ..... B65D 85/50
(52) U.S. Cl. ..... 206/423; 206/522
(58) Field of Search ..... 206/522, 588, 206/589, 486, 490, 423; 383/3

(56) References Cited

U.S. PATENT DOCUMENTS

| | | | | |
|---|---|---|---|---|
| 3,889,743 | | 6/1975 | Presnick | 165/46 |
| 4,093,068 | * | 6/1978 | Smrt | 206/522 |
| 4,465,188 | | 8/1984 | Soroka et al. | 206/522 |
| 4,551,379 | | 11/1985 | Kerr | 428/200 |
| 4,793,123 | | 12/1988 | Pharo | 53/449 |
| 5,427,830 | | 6/1995 | Pharo | 428/35 |
| 5,476,175 | | 12/1995 | Jaszai | 206/522 |
| 5,480,029 | | 1/1996 | Batsford | 206/522 |
| 5,564,570 | | 10/1996 | Jaszai | 206/523 |
| 5,570,788 | | 11/1996 | Batsford | 206/522 |
| 5,620,096 | | 4/1997 | Pozzo | 206/450 |
| 5,791,477 | * | 8/1998 | Batsford | 206/522 |
| 5,996,798 | * | 12/1999 | Gessert | 206/521 |

* cited by examiner

*Primary Examiner*—David T. Fidei
(74) *Attorney, Agent, or Firm*—Dunlap, Codding & Rogers, P.C.

(57) ABSTRACT

An inflatable shipping device for protecting at least one fragile item during shipment is provided. The inflatable shipping device includes a housing defining a gas receiving cavity and being constructed of a flexible and substantially gas impermeable material. The housing has a flattened state when the gas receiving cavity is substantially free of gas and an expanded state when gas is introduced into the gas receiving cavity. The housing has a first side, an opposed second side, a first end, an opposed second end, and a flexible inner-liner defining at least one item receiving chamber positioned between the first end and the second end. The item receiving chamber communicates with the first side of the housing and the item receiving chamber is sized and dimensioned to receive at least a portion of the fragile item. The inflatable shipping device is also provided with an inflation assembly for introducing gas into the gas receiving cavity defined by the housing. In one embodiment, the housing is provided with a helical shape so as to surround and thereby define the item receiving chamber.

7 Claims, 4 Drawing Sheets

INFLATABLE SHIPPING DEVICE

CROSS REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

In the process of shipping an article from one location to another, the article is typically placed in a container along with the protective packaging material to fill the voids about the article to cushion the article during the shipping process. One common protective packaging material is comprised of a plurality of plastic foam, peanut shaped members which are commonly known as "styrofoam peanuts". An advantage in using styrofoam peanuts is the ease with which they may be disposed about articles positioned in a container by simply pouring the styrofoam peanuts from a dispenser.

However, while styrofoam peanuts have been widely accepted in the packaging industry, they are not without disadvantages. For example, the light weight and flowability of the styrofoam peanuts results in heavier objects gravitating through the peanuts to the bottom of the container where the object can be damaged. Also, while the flowability of the styrofoam peanuts facilitates the introduction of the peanuts in the container, the receiver of the package is left with having to deal with the peanuts upon removal of the article from the container in the form of having to clean up the mess left by the peanuts which are easily scattered upon removal of the article from the container.

These and other disadvantages associated with the disposal of styrofoam peanuts has made paper protective packaging material a popular alternative. Paper is biodegradable, recyclable and renewable, making it an environmentally responsible choice. However, like styrofoam peanuts, paper packaging materials are not without disadvantages in that paper, particularly shredded paper, can be inconvenient to clean up and to dispose of due to the lack of cohesiveness of the packaging material. In addition, due to the lack of resiliency in paper products, large amounts of paper are typically required to provide the bulk needed to adequately cushion an object.

Strips of sheet material formed into tufts have also been used for many years as a packaging material. More specifically, material known as decorative grass has been used in fruit baskets, easter baskets, picnic baskets and for other packaging and decorative purposes. A decorative grass of the prior art has been produced by numerous methods and from a variety of materials such as polymeric materials, paper, cellophane or the like. Typically, such materials are cut and shredded to produce segments having predetermined dimensions. As such, the decorative grass, styrofoam peanuts and paper materials described above can be inconvenient to clean up and to dispose of.

To this end, a shipping device is needed which overcomes the before mentioned disadvantages of prior art packaging materials. It is to such a shipping device that the present invention is directed.

BRIEF SUMMARY OF THE INVENTION

Broadly, the present invention is an inflatable shipping device for protecting at least one fragile item during shipment. The inflatable shipping device is provided with a housing defining a gas receiving cavity and being constructed of a flexible and substantially gas impermeable material. The housing has a flattened state when the gas receiving cavity is substantially free of gas and an expanded state when gas is introduced into the gas receiving cavity. The housing has a first side, an opposed second side, a first end, an opposed second end, and a flexible inner liner defining at least one item receiving chamber positioned between the first end and the second end.

The item receiving chamber communicates with the first side of the housing. The item receiving chamber is sized and dimensioned to receive at least a portion of the fragile item whereby when the housing is disposed in the expanded state and the fragile item is disposed within the chamber the housing encompasses at least a portion of the fragile item to protect the fragile item during shipment of the fragile item. The inflatable shipping device is also provided with an inflation assembly for introducing gas into the gas receiving cavity defined by the housing.

In one aspect, the housing of the inflatable shipping device includes at least two spatially disposed item receiving chambers with each of the item receiving chambers being disposed between the first end and the second end of the housing and both item receiving chambers communicating with the first side of the housing.

In another aspect, the flexible inner liner of the housing is automatically formable about various different shapes of fragile items to engage and closely follow the contours of each shape of fragile item when each fragile item is disposed in the item receiving chamber.

In yet another aspect of the present invention, the housing has a substantially helical shape in the expanded state so as to surround and thereby define an item receiving chamber sized and dimensioned to receive at least a portion of the fragile item whereby when the housing is disposed in the expanded state and the fragile item is disposed within the item receiving chamber the housing encompasses at least a portion of the fragile item to protect the fragile item during shipment of the fragile item.

DETAILED DESCRIPTION OF THE INVENTION

Figure 1:
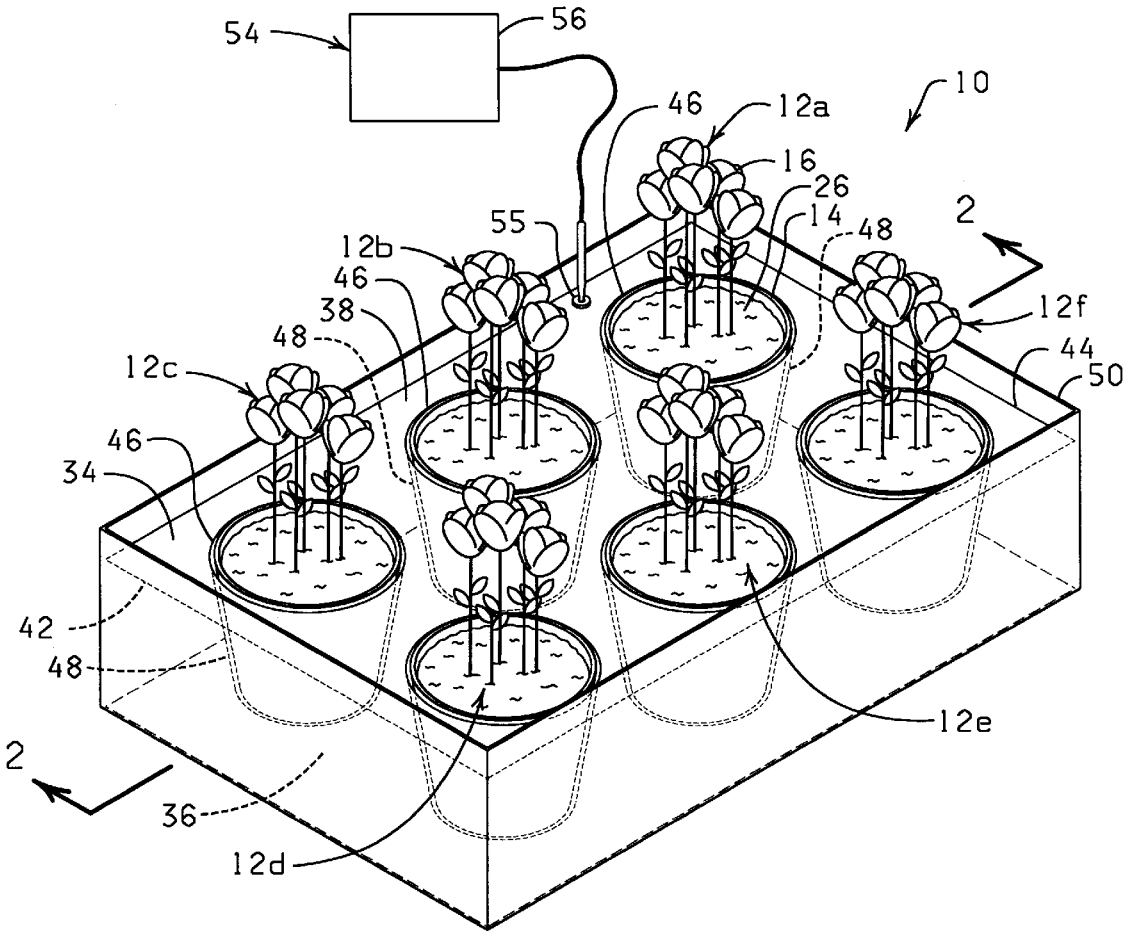
FIG. 1 a perspective representation of an inflatable shipping device, constructed in accordance with the present invention, positioned in a box.

Referring to the drawings, and in particular to FIG. 1 shown therein and designated by the general reference numeral 10 is an inflatable shipping device constructed in accordance with the present invention. The inflatable shipping device 10 protects at least one fragile item 12 during storage and/or shipment. Six fragile items 12 are shown in FIG. 1 by way of example, and designated therein by the general reference numerals 12*a–f*. The fragile item 12 can be any item to be protected against any type of damage, such as breakage, dents, scratches, chips, or any combinations thereof. For example, in the example shown in FIG. 1, the fragile item 12 is a flower pot 14 supporting a floral grouping 16 therein. For purposes of clarity, only the flower pot 14 and the floral grouping 16 of the fragile item 12*a* are numbered in FIG. 1.

Figure 2:
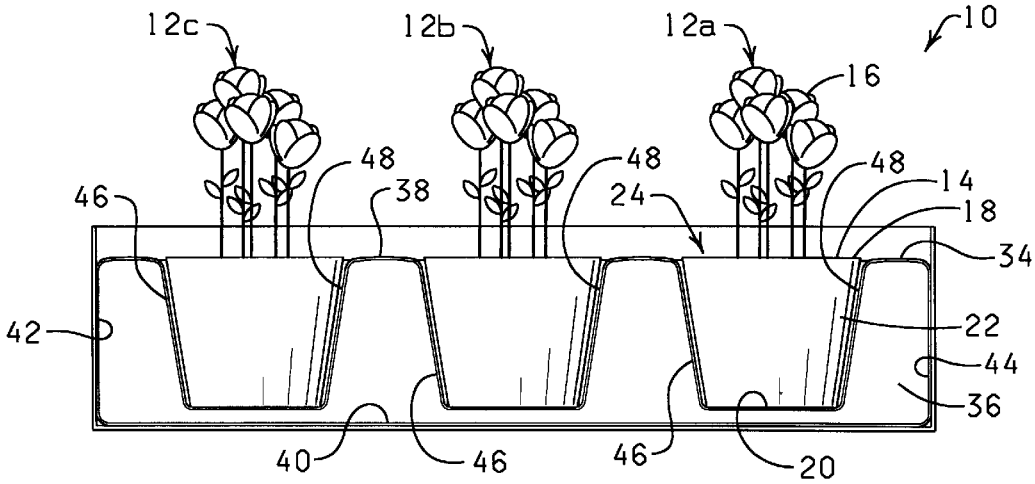
FIG. 2 is a cross-sectional representation of the inflatable shipping device depicted in FIG. 1 , taken along the lines 1—1 depicted in FIG. 1.

As best shown in FIG. 2, the flower pot 14 includes an upper end 18, a bottom 20, and a substantially continuous sidewall 22 extending there between. The bottom 20, and the sidewall 22 cooperate to define a receiving space 24 within the flower pot 14. The receiving space 24 is sized and dimensioned to receive a growing medium 26 (see FIG. 1) for supporting the floral grouping 16. "Floral grouping" as used herein means cut fresh flowers, artificial flowers, a single flower, other fresh and/or artificial plants or other floral materials that may include other secondary plants and/or ornamentation or artificial or natural materials which add to the aesthetics of the overall floral arrangement. Floral grouping may comprise a bloom or foliage portion and a stem portion. However, it will be understood that the floral grouping may consist of only a single bloom or only foliage. The term "floral grouping" may be used interchangeably herein with the term "floral arrangement".

The inflatable shipping device 10 includes a housing 34, defining a gas receiving catty 36. The housing 34 is constructed of a flexible and substantially gas impermeable material. The housing 34 can be constructed of a plastic material, canvas, or any other suitable flexible and substantially gas impermeable material. The housing 34 has a flattened state when the gas receiving cavity 36 is substantially free of gas (see FIG. 3), and an expanded state when gas is introduced into the gas receiving cavity (see FIGS. 1 and 2). The housing has a first side 38, an opposed second side 40, a first end 42, and an opposed second end 44. The housing 34 also includes at least one flexible inner liner 46 which has a predetermined shape to conform to the contours of the fragile item 12. In the example in FIG. 1, the housing 34 includes six flexible inner liners, three of which are designated in FIG. 2 with the reference numerals 46*a*, 46*b* and 46*c* for purposes of clarity. Although six flexible inner liners 46 are shown and described herein, it should be understood that the housing 34 could include any number of flexible inner liners 46, such as 1 or 10.

Each flexible inner liner 46 defines one item receiving chamber 48 positioned in between the first end 42 and the second end 44. The item receiving chambers 48 are designated in FIG. 2 by the reference numerals 48*a*, 48*b* and 48*c* for purposes of clarity.

Each item receiving chamber 48 communicates with the first side 38 of the housing 34. In addition, each item receiving chamber 48 is sized and dimensioned to receive at least a portion of the fragile item 12 whereby when the housing 34 is disposed within the item receiving chamber 38, the housing 34 encompasses and matingly engages at least a portion of the fragile item 12 to protect the fragile item 12 during shipment of the fragile item 12.

The flexible inner liners 46 are spatially disposed about the housing 34 so that each item receiving chamber 48 is substantially separated from the other item receiving chambers 48 so that the fragile items 12 disposed therein are spaced apart and will not touch each other when the fragile items 12 are positioned in the item receiving chambers 48.

The gas receiving cavity 36 may extend in between the flexible inner liner 46 and the second side 40 so that the bottom of the fragile item 12 is also cushioned and thereby protected. As best shown in FIG. 2, the housing 34 and the flexible inner-liners 46 are sized whereby the flexible inner-liner 46 substantially encompasses the fragile item 12 when the fragile item 12 is disposed in the item receiving chamber 48.

For example, when the fragile item 12 is a flower pot, the flexible inner-liner 46 may extend from the bottom 20 thereof to near the upper end 18 to substantially encompass the flower pot 14 so that the flower pot 14 will not move and/or tip over during shipment. Thus, only one inflatable shipping device 10 is necessary to ship a plurality of fragile items 12 in that all of the fragile items 12 may be fully supported by the inflatable shipping device 10.

The inflatable shipping device 10 may be sized and adapted to be disposed within a box 50 so that the fragile items 12 are cushioned from the box 50 during shipment or storage, for example. Although the box 50 is shown in FIG. 1 as extending generally below the top of the floral groupings 16 (i.e. fragile items 12, it should be understood that the box 50 can be sized to extend above the fragile items 12 so as to substantially encompass the fragile items 12 therein.

The inflatable shipping device 10 is also provided with an inflation assembly 54 for introducing gas into the gas receiving cavity 36 defined by the housing 34. The inflation assembly 54 is shown in FIG. 1 as a resealable hole 55 and a pump 56. The pump 56 can be utilized to add gas into the gas receiving cavity 36 to inflate the inflatable shipping device 10 through the resealable hole 55. Although the inflation assembly 54 has been shown in FIG. 1 as the resealable hole 55 in combination with the pump 56, it should be understood that the inflation assembly 54 may also include a nozzle, or a pressurized gas cartridge such as a co2 cartridge to add gas into the gas receiving cavity 36.

When the inflation assembly 54 includes the resealable hole 55, the gas may also be evacuated from the gas receiving cavity 36 and the housing 34*c* collapsed to the flattened state so as to conserve space until it is desired to reuse the inflatable shipping device 10. When it is desired to reuse the inflatable shipping device 10, gas can be reintroduced into the gas receiving cavity 36 via the inflation assembly 54, as discussed above.

Figure 3:
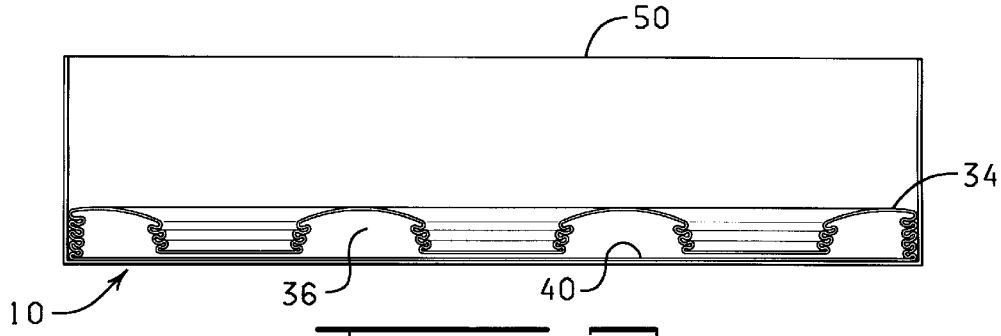
FIG. 3 is a cross-sectional representation of the inflatable shipping device depicted in FIG. 1, wherein the inflatable shipping device is shown in an uninflated or flattened state.

Referring now to FIG. 3, shown therein is the inflatable shipping device 10 disposed within the box 50 while the inflatable shipping device 10 is in the uninflated or flattened state. Once the inflatable shipping device 10 is positioned in the box 50, the inflation assembly 54 can be actuated or utilized to add gas to the gas receiving cavity 36 so that the housing 34 will expand to an expanded state and the inflatable shipping device 10 will be snugly disposed within the box 50.

Figure 4:
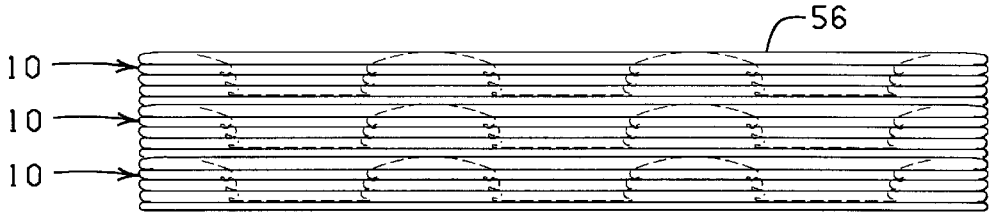
FIG. 4 a side elevational view of a plurality of the inflatable shipping devices in the uninflated state and stacked one on top of the other.

One advantage of the present invention is that the inflatable shipping device 10 may be shipped to a consumer in the uninflated or flattened stated to conserve space. Referring now to FIG. 4, shown therein is a side elevational view of a plurality of inflatable shipping devices 10 stacked one on top of the other to form a stack 56 of inflatable shipping devices 10.

In use, one of the inflatable shipping devices 10 is removed from the stack 56 and disposed in the box 50, if desired. The inflatable shipping device 10 is then inflated via the inflation assembly 54. Once the inflatable shipping device 10 is inflated, individual fragile items 12 can then be positioned in respective item receiving chambers 48 formed by the flexible inner liners 46 to protect the fragile items 12 from damage.

Figure 5:
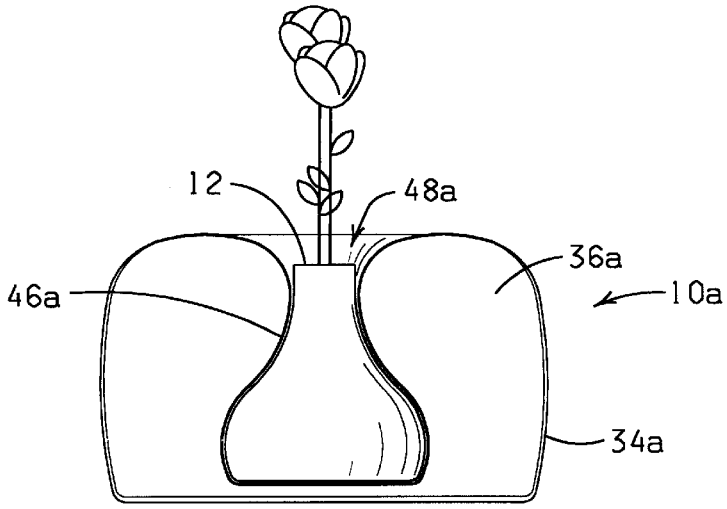
FIG. 5 is a cross-sectional representation of a second embodiment of an inflatable shipping device constructed in accordance with the present invention wherein the inflatable shipping device conforms about the contours of the fragile item being protected.
Figure 6:
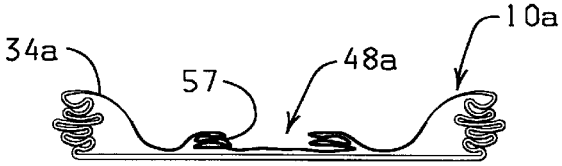
FIG. 6 is a cross-sectional representation of the inflatable shipping device of FIG. 5 when the inflatable shipping device is in the flattened state.

The Embodiment of FIGS. 5–6

Referring now to FIG. 5, shown therein and designated by the general reference numeral 10*a*, is an inflatable shipping device constructed in accordance with the present invention. The inflatable shipping device 10*a* is constructed and operated in an identical manner as the inflatable shipping device 10 herein above described with reference to FIGS. 1–4, except as discussed hereinafter. The inflatable shipping device 10*a* includes a housing 34*a* defining and encompassing a gas receiving cavity 36*a*. The housing 34*a* includes a flexible inner-liner 46*a*. The flexible inner-liner 46*a* is provided with an excess of material 57 (FIG. 6) so that the flexible inner liner 46 forms about the fragile item 12 as gas is supplied into the gas receiving cavity 36*a* in the housing 34, or as the fragile item 12 is inserted into an item receiving chamber 48*a* formed by the flexible inner-liner 46. Thus, the key difference between the inflatable shipping device 10*a* and the inflatable shipping device 10 is that an excess of material is provided with the flexible inner-liner 46 so that the flexible inner liner 46*a* automatically forms about the fragile item 12. Thus, the item receiving chamber 48*a* is provided with a shape substantially corresponding to the shape of any one of a number of different fragile items 12, while the item receiving chamber 48 of the inflatable shipping device 10 is provided with a predetermined shape typically corresponding to the shape of at least a portion of the fragile item 12.

FIG. 6 is a cross-sectional representation of the housing 34*a* in an uninflated or flattened state. Upon introducing gas into the gas receiving cavity 36*a*, and positioning the fragile item 12 in the item receiving chamber 48*a*, the flexible inner-liner 46*a* automatically forms about the fragile item 12 to securely hold and cushion the fragile item 12 during shipment and/or storage.

Figure 7:
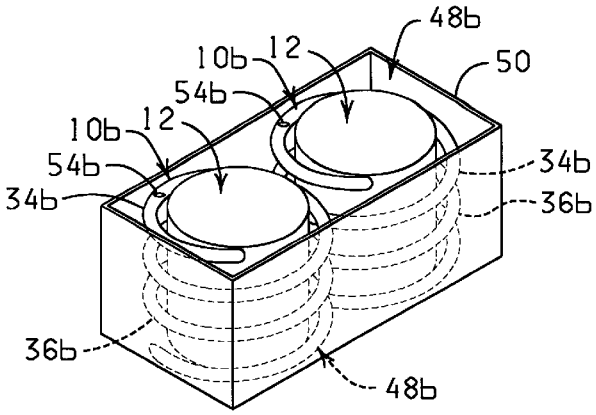
FIG. 7 is a perspective representation of a third embodiment of an inflatable shipping device constructed in accordance with the present invention.
Figure 8:
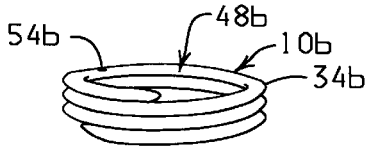
FIG. 8 is a perspective representation of the inflatable shipping device of FIG. 7 when the inflatable shipping device is in an uninflated or flattened state.

The Embodiment of FIGS. 7–8

Referring now to FIG. 7, shown therein and designated by the reference numeral 10*b* is another embodiment of an inflatable shipping device constructed in accordance with the present invention. The inflatable shipping device 10*b* protects at least one fragile item 12 during shipment and/or storage. Shown in FIG. 7, are two inflatable shipping devices 10*b* with each inflatable shipping device 10*b* being disposed about and cushioning one fragile item 12. It should be understand that two of the inflatable shipping devices 10*b* are shown in the box 50 merely by way of example and more or less of the inflatable shipping devices 10*b* could be disposed in the box 50.

The inflatable shipping device 10*b* includes a flexible housing 34*b* defining a gas receiving cavity 36*b*. The housing 34*b* is constructed of a flexible and substantially gas impermeable material, such as a plastic or a canvas material. The housing 34*b* has a flattened state (FIG. 8) when the gas receiving cavity 36*b* is substantially free of gas. The housing 34*b* has a substantially helical shape so that the housing 34*b* of the inflatable shipping device 10*b* surrounds and thereby defines an item receiving chamber 48*b*. The item receiving chamber 48*b* is sized and dimensioned to receive at least a portion of the fragile item 12 whereby when the housing 34*b* is disposed in the expanded state and the fragile item 12 is disposed within the item receiving chamber 48*b*, the housing 34*b* surrounds and encompasses at least a portion of the fragile item 12 to protect the fragile item 12 during shipment and/or storage of the fragile item 12.

As shown in FIG. 7, the two inflatable shipping devices 10*b* space the fragile items 12 apart from each other and the box 50 so that the fragile items 12 are cushioned.

The inflatable shipping device 10*b* also includes an inflation assembly 54*b*. The inflation assembly 54*b* can be constructed and operated in an identical manner as the inflation assembly 54, which was described herein before with reference to FIG. 1.

In use, gas is introduced into the housing 34*b* via the inflation assembly 54*b* to expand the housing 34*b* to the expanded state. The inflatable shipping device 10*b* is then positioned in the box 50, and the item 12 is positioned into the item receiving chamber 48*b* defined by the helically shaped housing 34*b*. Alternatively, the fragile item 12 can be positioned in the item receiving chamber 48*b* of the inflatable shipping device 10*b*, and then, the fragile item 12 and the inflatable shipping device 10*b* can then be simultaneously positioned in the box 50. These methods can then be repeated for any number of inflatable shipping devices 10*b* to be positioned into the box 50.

Figure 9:
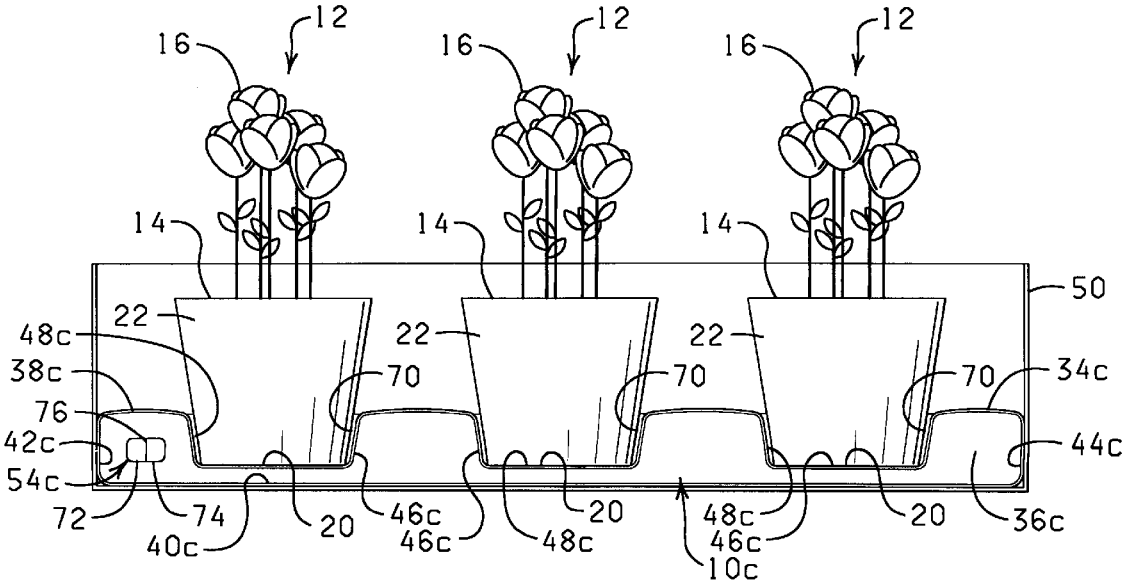
FIG. 9 is a cross-sectional representation of a fourth embodiment of an inflatable shipping device constructed in accordance with the present invention, wherein the inflatable shipping device extends only about the periphery of a lower portion of the fragile item to prevent the fragile item from tipping over.

The Embodiment of FIG. 9

Referring now to FIG. 9, shown therein and designated by the reference numeral 10*c* is another embodiment of an inflatable shipping device constructed in accordance with the present invention. The inflatable shipping device 10*c* is constructed and utilized in an identical manner as the inflatable shipping device 10, herein before described with reference to FIGS. 1–4, except as discussed hereinafter.

The inflatable shipping device 10*c* is provided with a housing 34*c* defining a gas receiving cavity 36*c*. The housing 34*c* is constructed of a flexible and substantially gas impermeable material, such as plastic or canvas. The housing 34*c* includes a first side 38*c*, an opposed second side 40*c*, a first end 42*c*, and an opposed second end 44*c*.

As will be discussed hereinafter, to support the fragile item 12 the housing 34*c* has at least one flexible inner liner 46*c*. The embodiment shown in FIG. 9 includes a plurality of flexible inner liners 46*c* for supporting a plurality of the fragile items 12, merely by way of example. The flexible inner liners 46*c* extend generally in between the first end 42*c* and the second end 44*c* of the housing 34*c* and each flexible inner liner 46 defines a respective item receiving chamber 48. Each item receiving chamber 48*c* communicates with the first side 38*c* of the housing 34*c*, and is sized and dimensioned to matingly receive only the bottom 20, and a lower portion 70 of the fragile item 12 so as to keep the fragile item 12 from tipping over upon placement of the fragile item 12 in the item receiving chamber 48*c*.

In this regard, the flexible inner liner 46*c* of the housing 34*c* does not surround or encompass the fragile item 12 entirely, but only surrounds or encompasses the bottom 20 and the lower portion 70 of the fragile item 12. For example, as shown in FIG. 9, when the fragile item 12 is the flower pot 14, the flexible inner liner 46*c* does not surround or encompass the flower pot 14 entirely, but engages, surrounds and extends only about the bottom 20 and the lower portion 70 of the sidewall 22 of the flower pot 14.

The inflatable shipping device 10*c* also includes an inflation assembly 54*c* for adding gas in to the gas receiving cavity 36. The inflation assembly 54*c* includes an effective amount of a first substance 72 and a second substance 74 disposed within the gas receiving cavity 36. The first substance 74 and the second substance 76 are capable of producing a chemical reaction upon contact to thereby produce an effective amount of gas to expand the housing 34*c* to the expanded state. For example, as shown in FIG. 9, the first substance 72 may be manganese dioxide and the second substance 74 could be an aqueous solution of hydrogen peroxide. Preferably, the two substances 72 and 74 are selected so as to not chemically react with each other at a high temperature, nor produce a gas which may damage the housing 34, or which may be harmful to humans and/or animals if exposed. The two substances 72 and 74 are separated by a thin membrane 76, which can be selectively ruptured by applying pressure to the membrane. It should be understood that the inflation assembly 54*c* can also be utilized to inflate the inflatable shipping devices 10, and 10*b*. It should also be understood that the inflation assembly 54*c* can be replaced with the inflation assembly 54, which was described hereinbefore with reference to FIG. 1.

Figure 10:
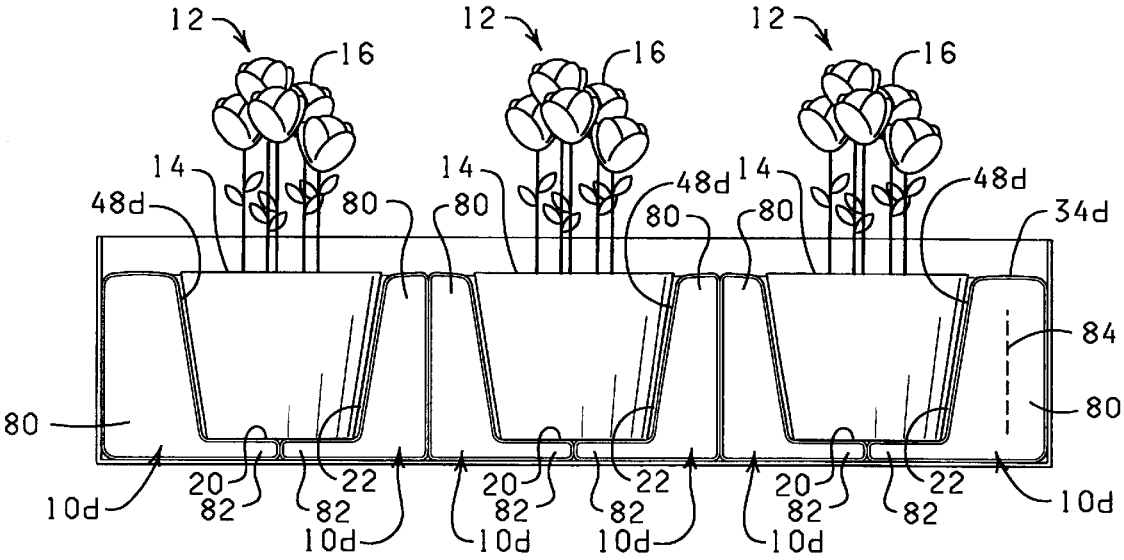
FIG. 10 is a cross-sectional representation of a plurality of inflatable shipping devices constructed in accordance with the present invention, wherein each of the inflatable shipping devices extends about only a portion of the periphery of the fragile item.

The Embodiment of FIG. 10

Referring now to FIG. 10, shown therein and designated by the reference numeral 10*d* is yet another embodiment of an inflatable shipping device constructed in accordance with the present invention for cushioning and supporting the fragile item 12. Each inflatable shipping device 10*d* is provided with a predetermined shape adapted to extend only about a portion of the fragile item 12, and thus, at least two of the inflatable shipping devices 10*d* are necessary to cushion and support each fragile item 12. For example, six of the inflatable shipping devices 10*d* are shown in FIG. 10 disposed in the box 50 for cushioning and supporting three fragile items 12. It should be understood that depending on the size and shape of the fragile item 12, and the size of the box 50, more or less of the inflatable shipping devices 10d can be disposed in the box 50 to cushion and support more or less than three fragile items 12. Each of the inflatable shipping devices 10*d* are substantially identical in construction and function. Thus, for purposes of clarity, only one of the inflatable shipping devices 10*d* will be described hereinafter.

The inflatable shipping device 10*d* includes a housing 34*d*. The housing 34*d* of the inflatable shipping device 10*d* is shaped to correspond to at least a portion of the fragile item 12 so that more than one of the inflatable shipping devices 10*d* can be positioned about the same fragile item 12 and cooperate to cushion and support the fragile item 12. The inflatable shipping device 10d will be described hereinafter by way of example as being shaped to correspond to at least a portion of the flower pot 14 having the floral grouping 16 disposed therein. However, it should be understood that the inflatable shipping device 10*d* of the present invention is not limited to only cushioning and supporting the flower pot 14 having the floral grouping 16 disposed therein.

When the fragile item 12 is the flower pot 14, the housing 34*d* of the inflatable shipping device 10*d* is shaped to form a first leg portion 80 for cushioning a portion of the sidewall 22 of the flower pot 14, and a second leg portion 82 for supporting and cushioning a portion of the bottom 20 of the flower pot 14. The second leg portion 82 extends away from the first leg portion 80 at an angle about normal with respect to an elongated axis 84 of the first leg portion 80.

The inflatable shipping device 10*d* includes an inflation assembly (not shown) for adding a suitable amount of gas to the gas receiving cavity 36*c*. The inflation assembly of the inflatable shipping device 10*d* may be constructed in an identical manner as the inflation assemblies 54 and 54*c*, which were discussed hereinbefore with reference to FIGS. 1 and 9.

In use, at least two of the inflatable shipping devices 10*d* are inflated via the inflation assembly and positioned such that the second leg portions 82 thereof are facing each other, and the housings 34*d* of the inflatable shipping devices 10*d* form an item receiving chamber 48*d*, which is sized and dimensioned to substantially encompass and surround the sidewall 22 of the flower pot 14. As shown in FIG. 10, a plurality of sets of the inflatable shipping devices 10*d* (with each set being positioned to form one item receiving chamber 48*d*) can be positioned into the box 50 to cushion and support multiple fragile items 12, such as the flower pot 14 supporting the floral grouping 16, and any suitable growing medium (not shown in FIG. 10). Once the inflatable shipping devices 10*d* are arranged into the sets, as discussed above, the fragile items 12, such as the flower pots 14 supporting the floral groupings 16, can then be positioned in respective item receiving chambers 48*d* to cushion and support the fragile items 12.

It should be understood that while the inflatable shipping devices 10, 10*a* and 10*c* have been shown with a generally rectangular shape, the inflatable shipping devices 10, 10*a* and 10*c* could be provided with any geometric, non-geometric or asymmetric shape so long as the inflatable shipping devices 10, 10*a* and 10*c* can function as set forth herein. Moreover, it should also be understood that the inflatable shipping devices 10, 10*a* and 10*c* can be adapted to cushion and support one or more than one fragile items 12.

Changes may be made in the various elements, components, parts and assemblies described herein or in the steps or sequences of steps of the methods described herein without departing from the spirit and the scope of the invention as defined in the following claims.

What is claimed is:

1. An inflatable shipping device for protecting at least one fragile floral item supporting a floral grouping during shipment, comprising:

a housing defining a gas receiving cavity and being constructed of a flexible and substantially gas impermeable material, the housing having a flattened state when the gas receiving cavity is substantially free of gas and an expanded state when gas is introduced into the gas receiving cavity, the housing having a first side, an opposed second side, a first end, and an opposed second end, and a flexible inner liner defining at least one item receiving chamber positioned between the first end and the second end, the item receiving chamber communicating with the first side of the housing, and the item receiving chamber being sized and dimensioned to matingly receive at least a lower portion of the fragile item so as to keep the fragile item from tipping over during shipment when the housing is disposed in the expanded state and the fragile item is disposed within the item receiving chamber, the housing being sized such that the floral grouping is extendable past the first side of the housing when the fragile item is disposed within the item receiving chamber; and means for introducing gas into the gas receiving cavity defined by the housing.

2. An inflatable shipping device as defined in claim 1, wherein the housing includes at least two spatially disposed item receiving chambers with each of the item receiving chambers being disposed between the first end and the second end of the housing and both item receiving chambers communicating with the first side of the housing.

3. An inflatable shipping device as defined in claim 1, wherein the inner liner is automatically formable about various different shapes of fragile items to engage and closely follow the contours of each shape of fragile item when each fragile item is disposed in the item receiving chamber.

4. An inflatable shipping device as defined in claim 1, wherein the flexible inner liner is preformed into the shape of at least the lower portion of the fragile item to engage and closely follow the contours of at least the lower portion of the fragile item.

5. An inflatable shipping device as defined in claim 1, wherein the inflation assembly includes at least an effective amount of two substances disposed within the gas receiving cavity which are capable of producing a chemical reaction upon contact to thereby produce an effective amount of gas to expand the housing to the expanded state.

6. An inflatable shipping device as defined in claim 1, wherein the housing only surrounds a bottom and a lower portion of the fragile item to prevent tipping of the fragile item during shipment.

7. An inflatable shipping device as defined in claim 1, wherein the housing is provided with a predetermined shape adapted to extend only about a portion of the fragile item whereby at least two of the inflatable shipping devices are necessary to cushion and support each fragile item.

* * * * *